US005520115A

United States Patent [19]

Braun

[11] Patent Number: 5,520,115

[45] Date of Patent: May 28, 1996

[54] TIMING AND SAFETY MODULE TO SEQUENCE EVENTS IN MISSILES

[75] Inventor: Christopher G. Braun, Golden, Colo.

[73] Assignee: The United States of America as represented by the Secretary of the Army, Washington, D.C.

[21] Appl. No.: 377,879

[22] Filed: Jan. 25, 1995

[51] Int. Cl.[6] ..... F42C 15/40

[52] U.S. Cl. ..... 102/215; 102/216; 102/218

[58] Field of Search ..... 102/200, 215, 102/216, 218, 220

[56] References Cited

U.S. PATENT DOCUMENTS 3,952,660 4/1976 Davis et al. ..... 102/215
4,541,341 9/1985 Fowler et al. ..... 102/215
5,245,926 9/1993 Hunter ..... 102/215
5,282,421 2/1994 Marsh et al. ..... 102/215
5,335,598 8/1994 Lewis et al. ..... 102/218
5,440,990 8/1995 Wiedefeld et al. ..... 102/215

*Primary Examiner*—Michael J. Carone
*Assistant Examiner*—Theresa M. Wesson
*Attorney, Agent, or Firm*—Michael Zelenka; John M. O'Meara

[57] ABSTRACT

A timing and safe module for firing a missile that provides timed DET trigger signals in response to a launch signal, a signal indicating that operating voltage is present and a signal indicating proximity to a target, as well as diagnostic signals indicating clock phasing.

7 Claims, 5 Drawing Sheets

TIMING AND SAFETY MODULE TO SEQUENCE EVENTS IN MISSILES

GOVERNMENT INTEREST

The invention described herein may be manufactured, used, and licensed by or for the Government of the United States of America without payment to me of any royalty thereon.

FIELD OF THE INVENTION

This invention relates in general to apparatus for controlling the operation of missiles in actual combat or in testing in a safe manner.

BACKGROUND OF THE INVENTION

In firing a missile, whether for test or in combat, it is important that the gun crew be given a signal indicating that all safety measures have been taken and that the missile is operative before it is fired. With a tandem or multiple charge warhead, a crush switch or other means provides a signal indicating that the missile has reached a predetermined position with respect to the target. A first charge, usually some type of shaped tip charge to defeat reactive armor, and other charges are detonated in timed sequence. The interval between detonations is usually less than two milliseconds and less than one microsecond accuracy is required. In addition, the timing of detonations should be adjustable.

In testing such a missile it is important to know the timing of the detonation signals as it may have to be adjusted in order to obtain best results.

SUMMARY OF THE INVENTION

This invention provides the first on-board completely self-contained electronic Timing and Safe Module. It incorporates redundant safety features and a plurality of delays between detonation signals from one microsecond to several seconds with sub-microsecond accuracy. Furthermore, it can be easily reconfigured for a different functionality by programming a programmable logic device, PLD, or by altering the way the lines normally carrying detonation signals are connected to triggers or other modules. The PLD chip is isolated from the noise and ground transients by completely isolating the power signals that carry out an intended function in response to the logic signals that control them.

Power may be provided to the module by charging a capacitor therein from a voltage source to which it is connected by a connector that comes apart on launch or by a battery. A signal is provided when the capacitor is suitably charged. A short circuit provided via the connector supplies a "not launch" signal indicating that a short circuit has been connected for preventing the module from producing detonation signals. When the module is powered up and the "not launch" signal is asserted, a "ready to launch" signal is asserted if no detonation signals are present and if means such as a crush switch does not indicate the proximity of a target.

At launch, a first counter starts counting, and when it reaches a given number, indicating-that the missile is far enough from the launch site to be safely detonated, a "ready to trigger" signal is asserted. Nothing further occurs until a crush switch or other means provides an "on target" signal indicating that the missile is within a given distance from the target. A first detonation signal is provided only if the "on target" signal is present for at least one clock cycle in order to avoid false detonation by noise. At a given counts after the "on target" signal, other detonator signals are respectively asserted.

For non-destructive test purposes, diagnostic means are provided for indicating the timing of the detonation signals, that can be transmitted by radio.

DETAILED DESCRIPTION OF THE INVENTION

Figure 1:
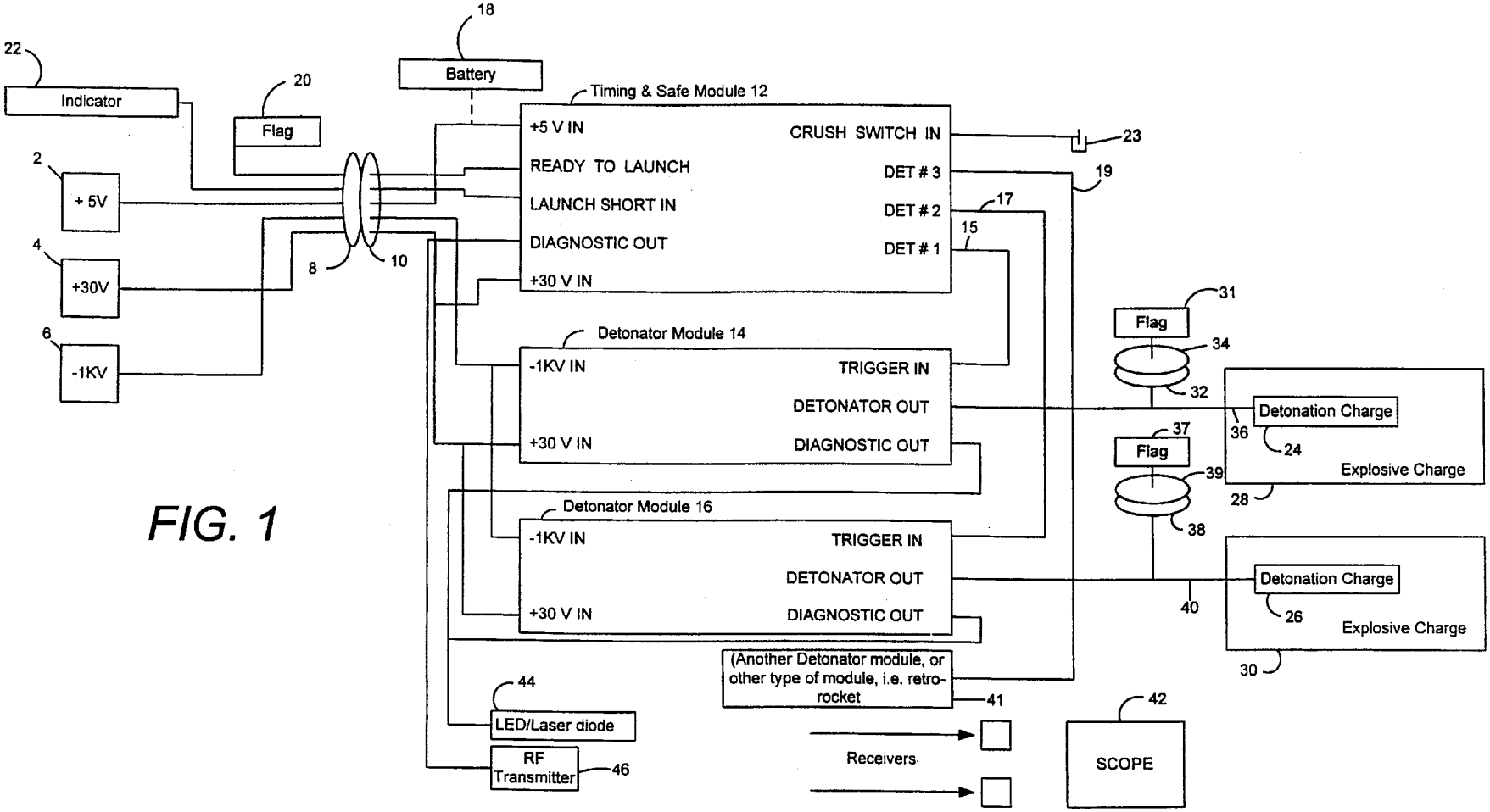
FIG. 1 is a block diagram of a missile launching system incorporating the invention.

Reference is made to FIG. 1 for an overall description of a missile launching system incorporating the invention. In this particular embodiment, sources 2, 4 and 6 of +5 v, +30 v and −1 Kv respectively are coupled via a breakaway connector 8, 10 to appropriate inputs of a Timing and Safe Module 12 and to detonator modules 14 and 16 as indicated. As will be explained, the module 12 contains a capacitor that is charged to the 5 volts so as to supply power after the connector 8, 10 has come apart at launch, but a battery 18 could be used in place of it, in which case the +5 v supply 2 is not required. A flag 20 indicates a short circuit; to external ground that is coupled via the connectors 8, 10 to the module 12. When, as will be shown, this short circuit is connected in the module circuit, its logic is such as to prevent the initiation of detonation trigger signals. This is a safety feature. At launch, the portion 8 of the connector 8, 10 is separated from the portion 10, so as to break the short circuit indicated by the flag 20 and permit the module 12 to derive detonation trigger signals. When the conditions in the module 12 are ready for a launch to occur, a signal is sent to an indicator 22 via the connector 8, 10.

In order to prevent an explosion close to the launch site, no detonation trigger signal is produced during a predetermined time after launch. Nothing further happens until means such as a crush switch 23 indicates that the missile is at a predetermined position with respect to the target. Then the module 12 provides detonation trigger signals DET #1, DET #2 and DET #3 to the detonator modules 14 and 16 and to the module 41 via leads 15, 17 and 19, respectively, at programmed times. They in turn supply detonation signals to detonation charges 24 and 26 that are mounted in explosive charges 28 and 30 respectively. As a further safety feature, a short circuit to module ground indicated by a flag 31 is connected via a breakaway connector 32, 34 to a lead 36 that carries the detonation signal from the detonator module 14 to the detonation charge 24, and another short circuit to module ground indicated by a flag 37 is connected via a breakaway connector 38, 39 to a lead 40 that carries the detonation signal from the detonator module 16 to the detonation charge 26.

At launch, the connector 8, 10 is pulled apart so as to break the connection to module ground, and when a projectile strikes a target, the connectors 32, 34 and 38, 39 are pulled apart so as to break the connections between the leads 36 and 40 to module ground and permit the detonation signals to reach the detonation charges 24 and 26 when they occur. Thus, even if a detonation signal is erroneously generated, an explosion is avoided. The short circuit indicated by the flag 20 is broken at launch, and the short circuits indicated by the flags 31, 37 are broken at the target.

As indicated at 41, a third detonator module or a different type of module such as a retro-rocket can be operated by the Timing and Safe Module 12. If it is a detonator module, it would be connected to a detonation charge, not shown, in the same way as the detonation modules 14 and 16, but if, it is a retro-rocket, it is coupled directly to the Timing and Safe Module 12 as shown.

In a testing procedure where the missile carries no detonation charges such as 24 and 26 and no explosive charges such as 28 and 30, the timing of the detonation signals can be conveyed to an oscilloscope 42 by means such as a laser diode 44, a sliding contact or radio transceiver, and diagnostic signals from the Timing and Safe Module 12 can be conveyed to the oscilloscope 42 by means such as a transmitter 46.

Figure 2:
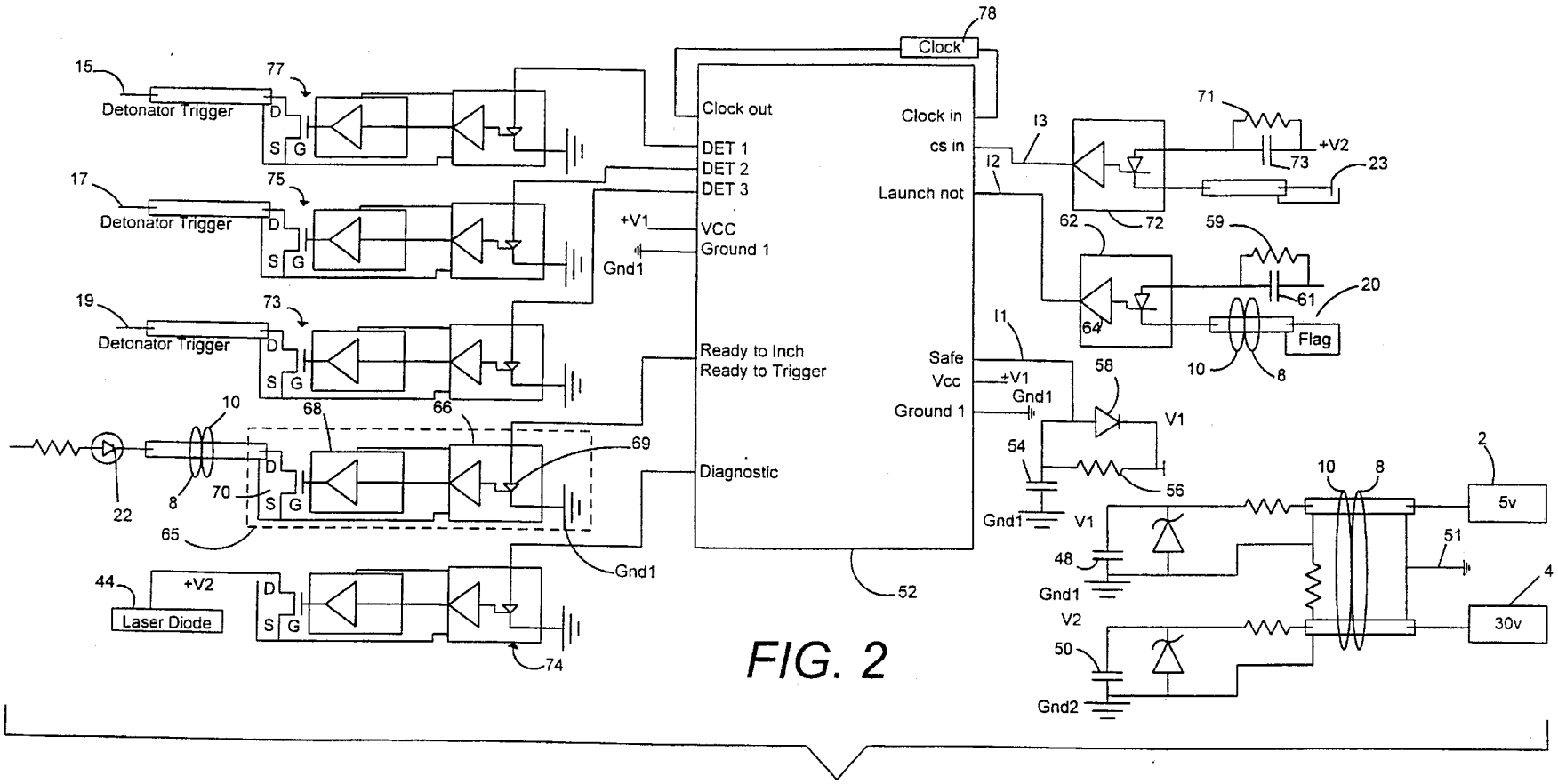
FIG. 2 is a schematic block diagram of a missile launching system incorporating the invention.

Reference is now made to the schematic diagram of FIG. 2 for a more detailed explanation of the various connections of FIG. 1. As in FIG. 1, the +5 v and +30 v sources 2 and 4 are coupled via the breakaway connector 8, 10 to capacitors 48 and 50 referred to in the description of FIG. 1 but not shown therein. Before the missile is launched and the connectors 8 and 10 are separated, the return path for the sources 2 and 4 is to earth ground 51, but after separation a charged voltage on a capacitor 48 is referenced to Gnd 1 and a charged voltage on a capacitor 50 is referenced to the Timing and Safe Module TSM 12 ground, Gnd 2. If the TSM 12 is powered by a battery 18, shown in FIG. 1, or batteries, the capacitor 48 is not necessary. In order to simplify the drawings, the +5 v and +30 v voltages on the capacitors 48 and 50 are respectively indicated as V1 and V2. The voltages V1 and V2 are applied where indicated, with V1 going to a programmable logic device, PLD, 52, which can be an EPM-5032, and which contains the logic circuits shown in FIG. 3, and with V2 going to all circuits on the sides of optoisolators to be described that are remote from the PLD 52. The separate grounds Gnd 1 and Gnd 2 for V1 and V2 provide better electrical isolation between the circuits of the PLD 52 and the entered circuits so as to prevent false operation.

The PLD 52 responds to three pairs of opposite input signals, one indicating whether or not it has been powered up, a second indicating whether or not launch has occurred and the third indicating whether the module is on or off the target.

The first pair of input signals is applied to an input $I_1$ and is produced as follows. A charge storage means such as a capacitor 54 is coupled between ground, Gnd 1, and the capacitor 48, where V1 appears, via a resistor 56 and a clamping diode 58 that is in parallel with the resistor. Thus, the capacitor 48, the resistor 56 and the diode 58 are means for charging the charge storage means 54. Because of the resistor 56, it takes a short time for the capacitor 54 to charge up to an operative value so as to provide operating voltage after a missile is launched. This slight delay is for the purpose of letting the logic circuits settle down. Before the capacitor 54 is charged, i.e. reaches a desired voltage level V1, the signal it supplies at $I_1$ is called a "not charged" signal, and when it is charged to the voltage level V1, the signal is called a "charged" signal. The diode 58 limits the voltage at $I_1$ to V1 volts.

The second pair of input signals is applied to an input $I_2$ and is produced as follows. The short circuit indicated by the flag 20 is coupled to the PLD 52 as explained in connection with FIG. 1 via the connector 8, 10, which is drawn again in the interest of simplicity in FIG. 2. With the indicated short circuit 20 in place, current drawn from the voltage source V2 via a filter comprised of a resistor 59 and a parallel capacitor 61 passes through an LED 60 of an optoisolator 62 to produce light that strikes a target 64 so as to produce a logic high voltage at $I_2$ that is connected to an input called "launch not" in the PLD 52. In this situation, the signal is a "not launched" signal, and, as will be explained in connection with FIG. 3, the PLD 52 is inhibited thereby from producing any detonation trigger signals.

When the PLD 52 responds to these pairs of signals at $I_1$ and $I_2$ to produce a "ready to launch" signal, that signal is applied via means 65 for activating the indicator 22, herein shown as an LED, through a FET 70. The means 65 includes an optoisolator 66, a high speed buffer 68 and the FET 70. The buffer 68 provides an impedance match and switches rapidly. In order to ensure electrical isolation between the PLD 52 and the indicator 22, the LED 69 of the optoisolator 66 is referenced to Gnd 1 and the rest of the means 65 operates in response to connections between V2 and Gnd 2, not shown. After launch, when the short circuit indicated at 20 is removed by breaking the connector 8, 10 apart and the signal at the input launch not, i.e. $I_2$, drops to logic low and is called a "launched" signal.

The third pair of signals is applied to an input $I_3$ and is produced as follows. In a manner to be explained in connection with FIG. 3A, the PLD 52 prevents any detonation trigger signals from being produced until a preprogrammed time after launch. When the normally open crush switch 23, which projects forwardly from the missile, strikes a target, it is closed so as to draw current from V2 through a filter comprised of a resistor 71 and a capacitor 73 and an optoisolator 72 to change $I_3$ from an "off target" logic low voltage to an "on target" logic high voltage which is connected to a "CS in" terminal on the PLD 52. Thus the circuit connections of the crush switch 23 to V2 are means for providing an "off target" signal and an "on target" signal. The PLD 52 then supplies sequential detonation trigger signals at terminals DET 1, DET 2 and DET 3. These signals are respectively coupled to the leads 15, 17 and 19 by activating circuits 77, 75 and 73 that are like the activating means 65 which conveys the "ready to launch" signal.

As described in connection with FIG. 1, diagnostic information is developed and coupled to a transmitter 44 via activating means 74 that is like activating means 65.

A conventional clock 78 is coupled to appropriate terminals on the PLD 52.

Figure 3A:
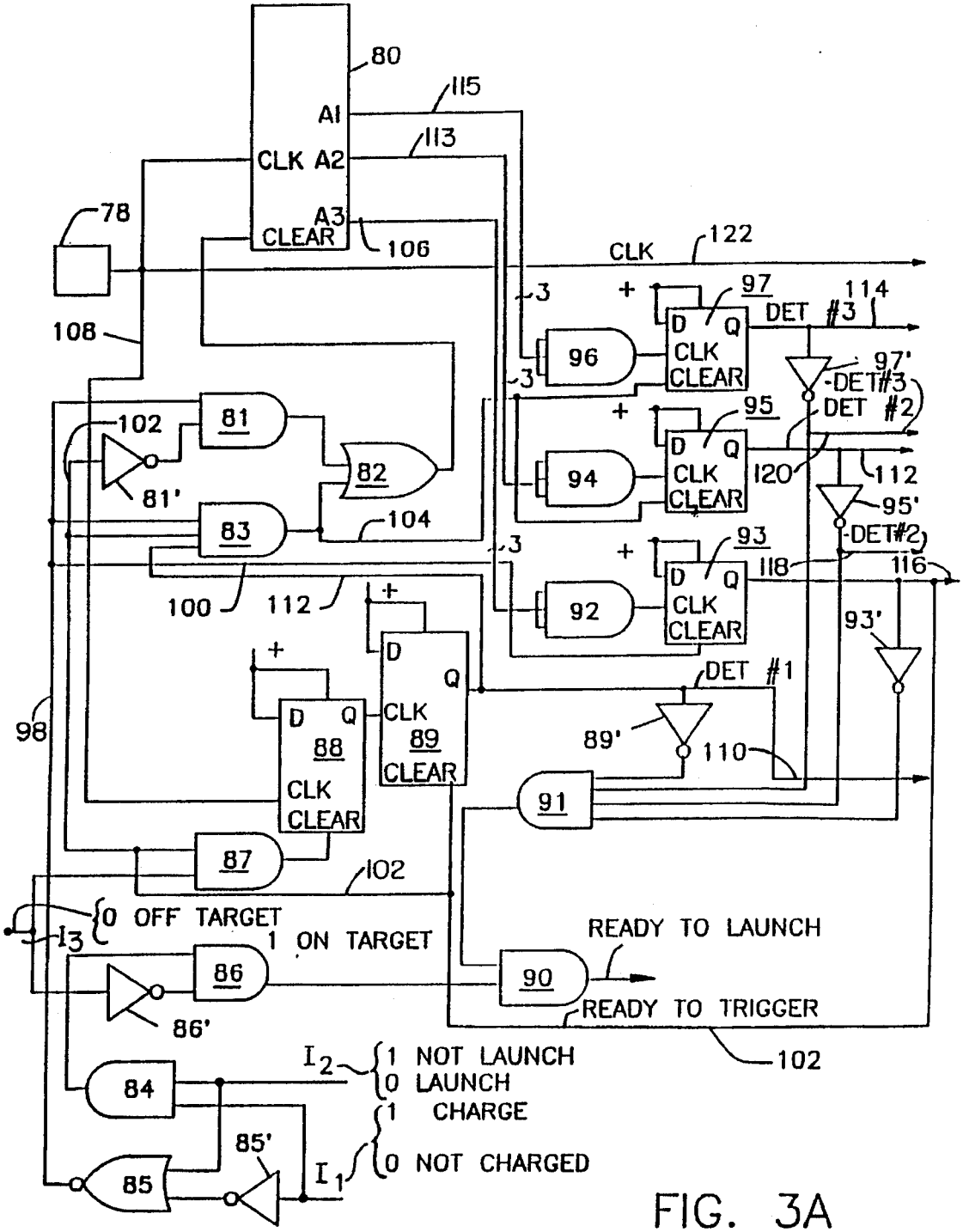
FIG. 3A is a schematic diagram of the logic circuits for the Timing and Safe module of the invention.

Reference is now made to FIG. 3A for a description of the logic circuits contained in the PLD 52 and their operation. In view of the fact that the various logic signals do not proceed through the logic devices in sequence but rather flow back and forth between them, they are numbered in sequence as they appear in the drawing so that they can be located more easily when referred to in this description. Inverters coupled to a device are designated by the same number as the device with a prime.

In addition to what has appeared in the other figures of the drawings, a counting means 80 that clears when a logic low appears at its clear input is included. As will be explained in connection with FIG. 4, the counting means 80 includes a plurality of groups of matrices. Each of the matrices of a group produces an output which is applied to the input of an AND gate so as to cause it to produce a 1 at a particular count. The outputs of the AND gates for one group are connected to respective outputs at A1, the AND gates for a second group are connected to respective outputs at A2, and the AND gates for a third group are connected to respective outputs at A3. Other counting means could be used, however.

The sequence of events is as follows. The missile or projectile to be launched, whether under test or in actual use, is placed in launching position with the Timing and Safe Module, TSM 12, attached to it. The timing of events has been previously programmed into the module 12, and the safety shorts for the detonation signal lines are connected. The latter will prevent an explosion if there is a malfunction in the TSM 12 that would cause a detonation trigger signal. Next, the launch short indicated by the flag 20 is connected so that when power is supplied, a "not launch" signal is applied to the PLD 52 at $I_2$. If there is to be an actual detonation, the detonators 24 and 26 are then placed in their respective explosive charges 28 and 30. Finally, the parts 8 and 10 of the connector 8, 10 are joined so that voltage is supplied to the TSM as well as to the detonator modules such as 14 and 16 of FIG. 1. This also connects the short indicated by the flag 20 to the circuit of the TSM 12 as indicated in FIG. 2.

After about the one second that it takes to charge the capacitor 54 of FIG. 2, the "not charged" signal 0 will become the "charged" signal of level 1 at the input $I_1$, and the input $I_2$ will be a "not launched" signal of level 1. Since the missile has not been launched, the input $I_3$ should have the "off target" value 0. The inputs $I_1$, $I_2$ and $I_3$ are also shown in FIG. 2.

READY TO LAUNCH SIGNAL

Means for providing a "ready to launch" signal are now described. Since $I_1$ is a 1 when the capacitor 54 is charged to V1 and $I_2$ is a 1 before the missile is launched 1's are the output of an AND gate 84 to which they are connected is 1 so that one input of an AND gate 86 is 1. Since $I_3$ is 0 when the crush switch 23 is open, the other input of the AND gate 86 will also be 1 because of an inverter 86'. Thus the output of the AND gate 86 is 1 so that one input of an AND gate 90 is 1. The other input to the AND gate 90 will also be 1 so as to produce the "ready to launch" signal if all inputs to an AND gate 91 are 1's. With $I_1$ and $I_2$ being 1's, the output of a NOR gate 85 is a 0 that is carried to the clera input of a D flip flop 93 via leads 98 and 100 so that its Q output will be a 0. As this Q output is conducted by a lead 102 to the clear input of a D flip flop 89, its Q output will also be 0. These 0 outputs are respectively inverted to 1's by inverters 93' and 89' so that two inputs of the AND gate 91 are 1's.

The other two inputs of the AND gate 91 will also be 1's for the following reasons. The lead 102 is also connected to one input of an AND gate 83. Since the lead 102 is now a 0, the output of the AND gate 83 is a 0 that is conducted to the clear inputs of D flip flops 95 and 97 by a lead 104. This causes the Q outputs of the flip flops 95 and 97 to be 0's that are inverted to 1's by inverters 95' and 97' before being applied to the other two inputs of the AND gate 91. Since all of its inputs are 1's, the output of the AND gate 91 will be a 1, and the output of the AND gate 90 will also be a 1 so as to indicate that the missile is ready to be launched.

READY TO TRIGGER SIGNAL

Means for producing a "ready to trigger" signal are now described. It will be recalled that the "ready to trigger" signal is a 1 that is produced at a preprogrammed time after launch. When the missile is launched, the short indicated by the flag 20, FIG. 2, is broken so that the not launch input, and thus the input $I_2$, is a 0. As a result, the output of a NOR gate 85 changes from a 0 to a 1 that is conveyed by the leads 98 and 100 to the clear input of the D flip flop 93, thereby enabling it to transfer its D input, which is at a high logic level 1, to its Q output when it receives a 1 from an AND gate 92 at its clock input. This will occur when the counting means 80 reaches a number that equals a preset count at which the three leads 106 that are connected to respective outputs at A1 carry 1's.

The counting means 80 operates as follows. Previously, the output of the NOR gate 85 was 0 so that the output of an AND gate 81 to which it is coupled is a 0. As previously pointed out, the Q output of the D flip flop 93 that is applied to the lead 102 was 0 so that the output of-an AND gate 83 is 0. Since both inputs of an OR gate 82 are therefore 0's, its output will be a 0. The output is connected to the clear input of the counting means 80 so that the counting means 80 will clear itself on each clock pulse from the clock 78. Means for permitting the counting means 80 to count are as follows. At launch both inputs of the NOR gate 85 are 0's so that its output becomes a 1, and since the lead 102 is still a 0, both inputs of the AND gate 81 are 1's and its output is therefore a 1, thus making the output of the OR gate 82 a 1 that permits the counting means 80 to count. When the counting means 80 reaches a given number, three outputs at $A_1$ will be 1's that are conveyed to the inputs of the AND gate 92 via thru leads 106 so that the + voltage applied to the D input of the D flip flop 93 will be transferred to its Q output. This is the ready to trigger signal.

Of course, when this occurs, the 1 at the Q output of the D flip flop 93 will be inverted to a 0 by the inverter 93' so that one input of the AND gate 91 will be a 0. Its output will then be a 0 and erase the ready to launch signal by causing an input of the AND gate 90 to be a 0 and thus cause the output of the AND gate 90 to go to 0.

When the ready to trigger signal is asserted by the Q output of the D flip flop 93 becoming a 1, the output of the OR gate 82 becomes a 0 so as to reset or clear the counting means 80. A means for clearing the counting means 80 in response to the "ready to trigger" signal is now described. This occurs because when the "ready to trigger" signal becomes 1, the lead 102 also becomes a 1 that is inverted by the inverter 81' to make an input of the AND gate 81 a 0 so that its output becomes 0. Although the lead 102 being a 1 when the ready to trigger signal is asserted readies the D flip flop 89 for the transfer of its D input, which is +, to its Q output, this will not occur until the D flip flop 89 receives a pulse at its clock input from the Q output of a D flip flop 88. Thus the Q output of the D flip flop 89 is still 0 and makes the output of the AND gate 83 a 0 because the Q output of the D flip flop 89 is connected by a lead 108 to an input of the AND gate 83. Since both inputs of the OR gate 82 are 0, its output becomes 0 so as to clear the counter 80. The reason why no clock pulse is applied to the D flip flop 89 from the Q output of the D flip flop 88 will be clear when its function is explained below.

DETONATION TRIGGER DET #1

The detonation trigger, DET #1, occurs when the crush switch 23 of FIG. 2 is closed by striking a target or when some other means indicates that the missile is at a predetermined distance from the target. However, in order to check for transient noise, an inquiry is made by the checking means described below to see if the crush switch 23 is still closed after one clock cycle in order to be certain that it is closed. When the crush switch 23 closes, the input $I_3$ becomes an "on target" signal 1. Since the "ready to trigger" signal on the lead 102 is also a 1, an AND gate 87 outputs a 1 to the clear input of the D flip flop 88, thus transferring the 1 at the D input of the flip flop 88 to its Q output when a clock pulse is received on the lead 108. When this clock pulse occurs, the D flip flop 89 is clocked so as to transfer the 1 at its D input to its Q output, thus providing the DET #1 trigger signal on a lead 110. Thus, the AND gate 87 is a means for activating the checking means comprised of the D flip flop 88 and 89 to produce a DET #1 signal in response to the "on target" signal and the "ready to trigger" signal.

DETONATION TRIGGERS DET #2 and #3

When DET #1 occurs, it is applied via the lead 112 so as to make all of the inputs to the AND gate 83 1's and its output a 1. This causes the OR gate 82 to output a 1 and permit the counting means 80 to count. Thus the AND gate 83 is a means for producing an enabling signal in response to a DET #1 signal, a "launched" signal, a "charged" signal and a "ready to trigger" signal, and it and the OR gate 82 constitute means for permitting the counting means to count in response to the enabling signal. The lead 104 is now a 1 so that the D flip flops 95 and 97 are enabled to transfer their D inputs to their Q outputs when they receive a + at their clock inputs from the respective AND gates 94 and 96. When the counting means 80 reaches a count that makes all the leads 113 at an output $A_2$ and thus the inputs of the AND gate 94 1's, the AND gate 94 clocks the D flip flop 95 to cause it to transfer the 1 at its D input to its Q output. This is the DET #2 signal on lead 112. Thus the AND gate 94 and the D flip flop 95 are means for producing a DET #2 signal responsive to said enabling signal. Similarly, when the counting means 80 reaches another count so as to make all the leads 115 at an output $A_3$ 1's, the DET #3 trigger signal will appear at the Q output of the D flip flop 97 on lead 114.

Figure 4:
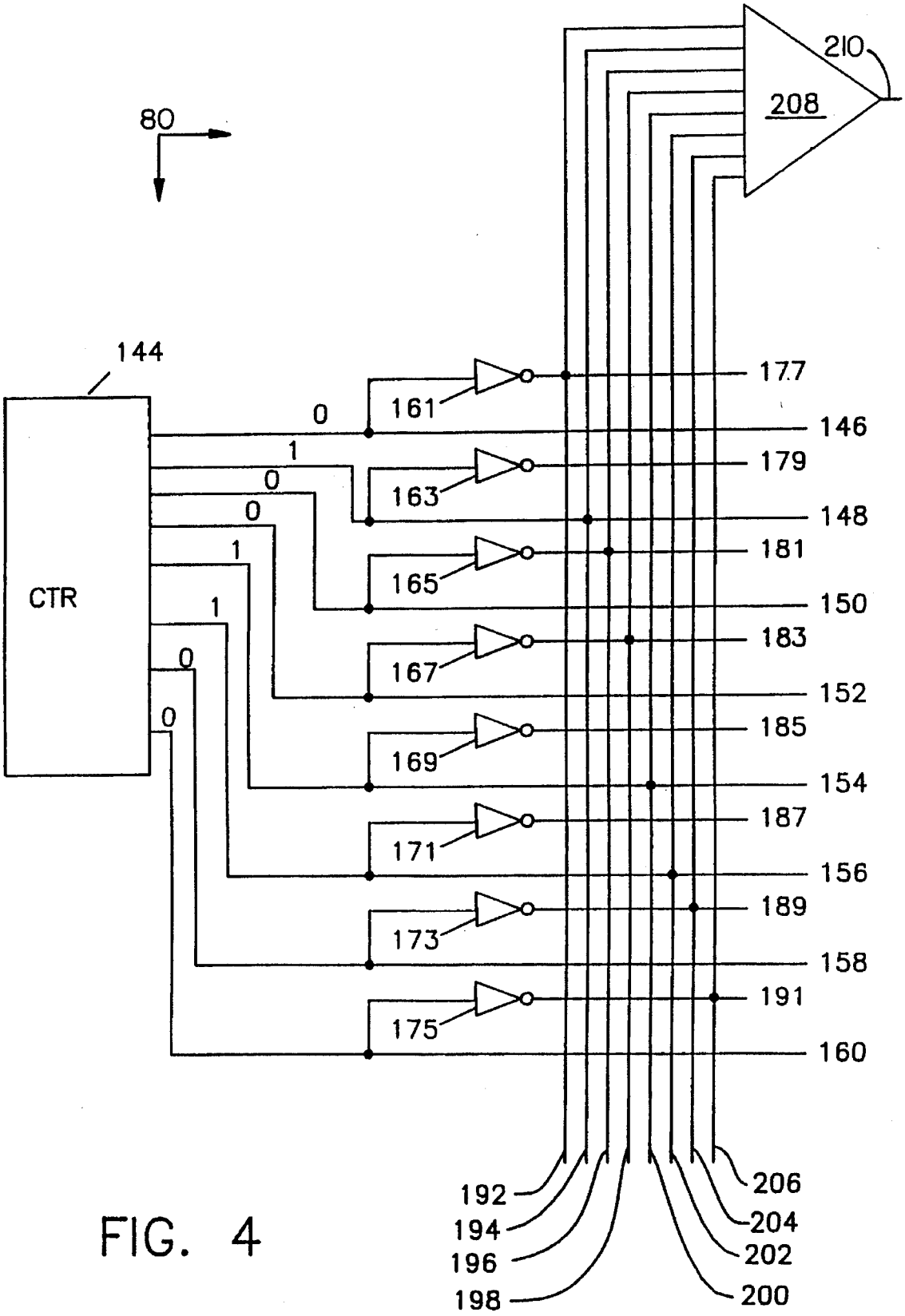
FIG. 4 illustrates the operation of a counting means used in the invention for timing detonation trigger signals.

The DET #1, DET #2, DET #3 signals, with the "ready to trigger" signal, the –DET#2, –DET #3 signals, and the clock signal are respectively applied to the diagnostic circuit of FIG. 4 via the leads 110, 112, 114, 116, 118, 120 and 122. Only one of the DET #1, DET #2, and DET #3 signals are a 1 at any time.

DIAGNOSTIC CIRCUITS

Figure 3B:
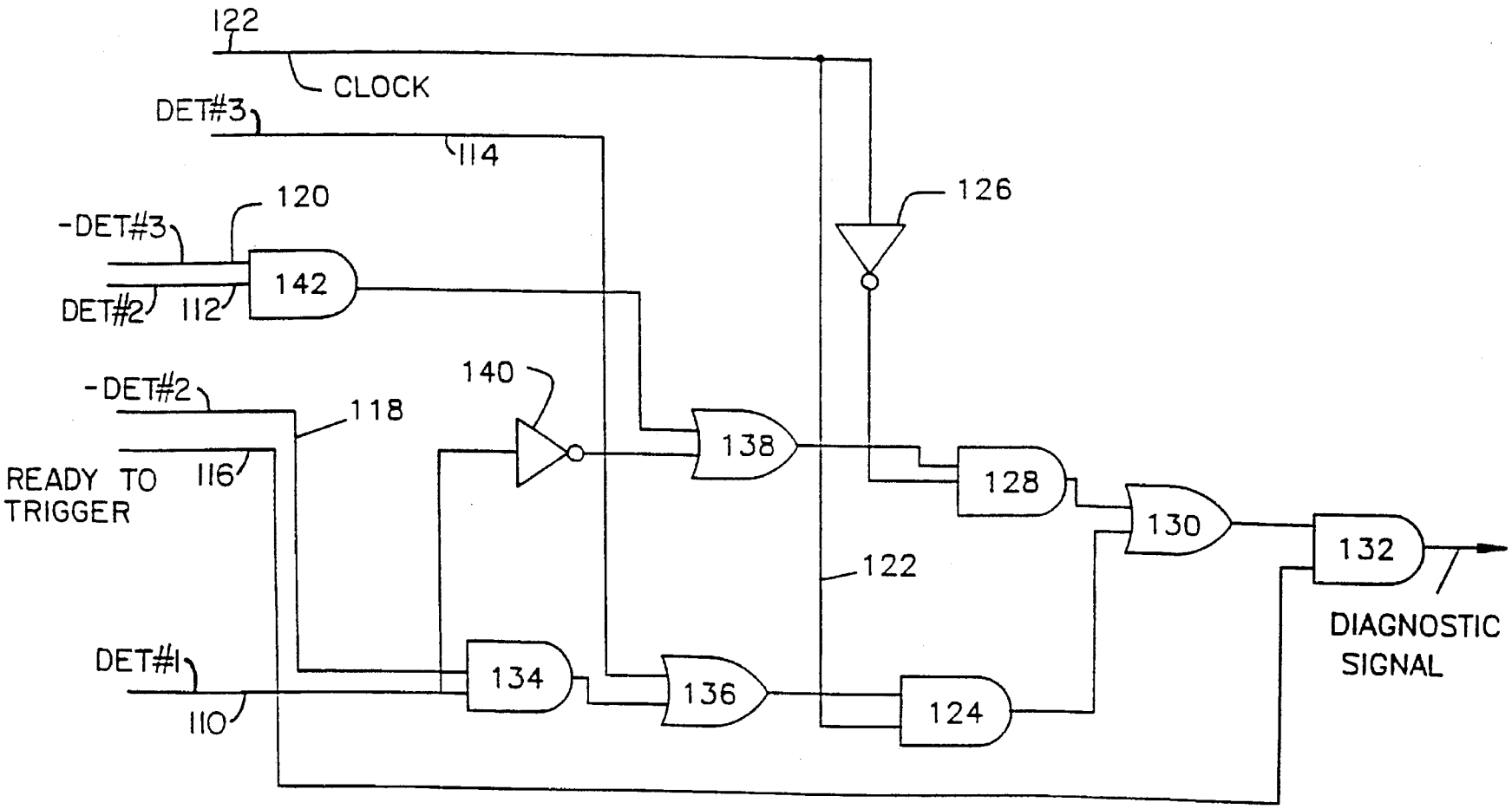
FIG. 3B is a schematic diagram of logic circuits for providing the diagnostic data of the invention.

Reference is made to FIG. 3B for the description of a diagnostic circuit that changes the phase of a clock signal to indicate when the various detonation events occur. One phase of the clock signal that is on the lead 122 is applied to an input of an AND gate 124, and the inverted phase provided by an inverter 126 is applied to one input of an AND gate 128. The outputs of the AND gates 124 and 128 are connected to different inputs of an OR gate 130, and its output is connected to one input of an AND gate 132. When detonation events are occurring, the "ready to trigger" signal on the lead 116 is applied to the other input of AND gate 132 so that the phase of the clock signals at its output depends on which of the AND gates 124, 128 is controlling the OR gate 130.

When the DET #1 signal on the lead 110 is asserted, so as to be a 1, the –DET #2 signal on the lead 118 is also a 1 so that the output of an AND gate 134 to which these signals are applied is a 1, and one input of an OR gate 136 to which the AND gate 134 is connected is a 1. At this time, DET #3 on the lead 114 that is connected to the other input of the OR gate 136 is a 0. The output of the OR gate 136 is connected to a different input of the AND gate 124 than the lead 122. Under this condition, the output of the AND gate 124 will be in phase with the in phase clock signal on the lead 122. As previously stated, the output of the AND gate 124 is connected to one input of the OR gate 130, and if its other input remains at 0, the in phase clock signal will appear at its output as well as at the output of the AND gate 132.

In order to insure that the AND gate 128 is unaffected by the inverted clock signal applied to one input thereof, the Other input thereof that is connected to the output of an 0R gate 138, must be 0. The DET #1 signal is applied by an inverter 140 to one input of the OR gate 138. The other input of the OR gate 138 is connected to the output of an AND gate 142. Since one input of the AND gate 142 is connected to receive the DET #2 signal on the lead 112, and since that signal is now a 0, the output of the OR gate 138 and one input of the AND gate 128 will be 0's. Therefore, the inverted phase of the clock signal supplied to the other input of the AND gate 128 will have no effect.

When, however, DET #2 is asserted, DET #1 and DET #3 are 0's, and the inverted clock signal from the inverter 126 will control the output of the AND gate 128 because its other input is a 1 owing to the application of the inverted DET #1 to one input of the OR gate 138. The output of the AND gate 128 will control the output of the OR gate 130 and hence the output of the AND gate 132 that supplies the diagnostic signal if the input of the OR gate 130 that is connected to the output of the AND gate 124 remains at 0. That this is so can be seen from the fact that the output of the AND gate 134 that is connected to one input of the OR gate 136 is 0 because DET #1 is 0 and because DET #3 that is connected to the other input of the OR gate 136 is 0. Thus one input of the AND gate 124 remains at 0 during the clock cycles.

One skilled in the art of logic circuits would understand without further explanation how the circuit changes the phase of the clock signal at the output of the AND gate 132 by 180° when DET #3 is asserted.

Reference is made to the matrix of FIG. 4 for an explanation of the operation of the counter means 80. Only one matrix arrangement is shown therein to avoid redundancy. In this arrangement, a counter 144 has eight outputs that are applied directly to even numbered leads 146 to 160 in a logic arrangement and by respective odd numbered inverters 161 to 175 to odd numbered leads 177 to 191 therein. Eight even numbered conductors 192–206 that are shown as being orthogonal to the even and odd numbered leads for ease of illustration are respectively connected to inputs of an AND gate 208.

At any given count of the counter 144, its eight outputs will have given 0's or 1's that respectively appear on the even numbered leads 146 through 160. The even numbered leads that are connected to outputs of the counter 144 having 1's are respectively connected to different conductors 192–206. The odd numbered leads that are connected via inverters to outputs having 0's are respectively connected to the other conductors 192–206 so that all the conductors are 1's and the output 210 of the AND gate 208 is a 1. This will occur at only one count of the counter 144. By employing three counter arrangements such as shown in FIG. 4, the inputs of the AND gate 92 can be 1's at a desired number. Three additional counters such as shown in FIG. 4 would be used to make the inputs to the AND gate 94 high at a second number, and three more counters such as shown in FIG. 4 would be used to make the inputs to the AND gate 96 high at a third number.

By way of example, if the indicated outputs of the counter 144 represented a desired number at which the output 210 of the AND gate 208 is to be a logic high, the connections shown by dots would be made.

The outputs of the AND gates 208 of the matrices of one group that are like that of FIG. 4 may be connected to through respective outputs, not shown, of A1 that are respectively connected to leads 106. Other groups of matrices are similarly connected to the outputs A2 and A3.

Operation

As a safety feature, a "ready to launch" signal is provided by the AND gate 90 when the signal $I_3$ provided by the crush switch 23 indicates that the crush switch is not closed and that all the Q outputs of the D flip flops 89, 95 and 93 at which detonation signals are to appear are low so that detonation will not occur. In addition, the "ready to launch" signal does not occur unless the Q output of the D flip flop 93 is low indicating that a "ready to trigger" signal is not asserted. The means for providing the "ready to launch" signal includes the inverter 86' the AND gates 84, 86, 90, and 91 and the inverters 93', 95' and 97'.

Before launch, the counting means 80 is cleared by means including the NOR gate 85, the AND gates 81, 83 and the 0R gate 82 in response to either the "not launch" or the "not charged" signals. In response to the "launch" signal the same means cause the counting means 80 to start counting.

When the counting means 80 reaches a first given number, means including the AND gate 92 and the D flip flop 93 produces a "ready to trigger" signal that resets the counting means 80 and enables the D flip flop 89 in the checking means comprised of the D flip flops 88 and 89.

Nothing further occurs until the missile is at a predetermined distance from the target that is indicated by $I_3$ becoming high at the closing of the crush switch 23 or as a reaction to other means. When this occurs, the checking means 88, 89 outputs DET #1 if the signal at $I_3$ remains high for at least one clock cycle. This delay of one clock cycle prevents DET #1 from occurring as a result of a spike of noise.

When the counting means 80 reaches a second given number, DET #2 is provided by means including the AND gate 94, and the D flip flop 95, and when the counting means 80 reaches a third number, DET #3 is provided by means including the AND gate 96 and the D flip flop 97.

What is claimed is:

1. Apparatus for providing detonation signals at times when different explosive charges of a missile are to be ignited comprising:

charge storage means;

means for charging said charge storage means to a desired voltage level;

means for providing a "not charged" signal when the voltage level of said charge storage means is not as desired and a "charged" signal when such level is as desired;

means for providing a "not launched" signal before said missile is launched and a "launched" signal after it is launched;

means for providing an "off target" signal when said missile is greater than a given distance from a target and an "on target" signal when said missile is less than a given distance from the target;

a clock;

counting means coupled to said clock;

means for clearing said counting means responsive to said "not launched" signal and said "charged" signal;

checking means for providing a DET #1 signal after a given number of clock cycles when activated and a non DET #1 signal when inactivated coupled to said clock;

means for providing a "ready to launch" signal in response to said counting means having a count less than a given value, said non DET #1 signal, said "off target" signal, said "not launched" signal and said "charged" signal;

means for enabling said counting means to count responsive to said "launched" signal and said "charged" signal;

means for providing a "ready to trigger" signal responsive to said counting means reaching a first count, said "launched" signal and said "charged" signal;

means for clearing said counting means responsive to said "ready to trigger" signal;

means for activating said checking means to produce said DET #1 signal responsive to said "on target" signal and said "ready to trigger" signal;

means for producing an enabling signal in response to said DET #1 signal, said "launched" signal, said "charged" signal and said "ready to trigger" signal;

means for permitting said counting means to count responsive to said enabling signal; and means for producing a DET #2 signal responsive to said enabling signal and said counting means reaching a second count.

2. Apparatus as set forth in claim 1 further comprising:

means for providing a DET #3 signal responsive to the "ready to trigger" signal, the DET #1 signal, the "launch" signal, the "charge" signal and the counter reaching a third count.

3. Apparatus as set forth in claim 2, further comprising means for deriving a diagnostic signal at a diagnostic output, said means comprising:

means for producing a clock signal of one phase at said diagnostic output responsive to the DET #1 signal and the signal from said clock; and means for reversing the phase of said clock signal at said diagnostic output responsive to said DET #2 signal.

4. In apparatus as set forth in claim 2, means for deriving a diagnostic signal at a diagnostic output, said means comprising:

means for producing a clock signal of a given phase at said diagnostic output responsive to said DET #1 signal and the clock signal from said clock;

means for reversing the phase of said clock signal at said diagnostic output responsive to said DET #2 signal; and means for again reversing the phase of said clock signal at said diagnostic output responsive to said DET #3 signal.

5. Modules for providing detonation signals to ignite explosive charges of a missile at different times, comprising:

capactive means that can be charged before a missile is launched to provide operating voltages after a missile is launched;

means for producing a "charge" signal for indicate when said capacitors are charged to a given level;

control means for indicating whether a missile has been launched or not that is adapted to be placed in a first position by an operator before the missile is launched and which is forced into a second position when the missile is launched;

at least one output terminal at which a detonation signal is to be applied;

means for indicating that a missile is ready to be launched responsive to said "charge" signal, said control means being in said first position and there being no detonation signals available at any output terminal;

means for producing a "ready to trigger" signal responsive to said "charge" signal and to said control means being placed in the second position;

means for producing an "on target" signal when the missile is within a given distance of a target;

means for providing a DET #1 signal at an output terminal responsive to said "on target" signal and said "ready to trigger" signals both being asserted for a predetermined time; and means for providing a DET #2 signal that occurs a predetermined time after said DET #1 signal responsive to said "ready to trigger" signal, said DET #1 signal, the "charge" signal and said control means being in said second position.

6. Apparatus for producing a detonation signal for a missile comprising:

means for producing a "launch" signal when the missile is launched;

a clock;

counting means coupled to said clock so as to count its cycles;

means for enabling said counting means to start counting in response to said "launch" signal;

means for providing a "ready to trigger" signal and for clearing said counting means when said counting means reaches a given number;

means for producing an "on target" signal when said missile is a given distance from a target and for starting said counting means to count;

means for producing DET #1 signal at an output in response to said "on target" signal; and checking means for permitting the production of the DET #1 signal only if the "on target" signal is present for a predetermined time.

7. Apparatus as set forth in claim 6, further comprising:

means for producing a "not launch" signal indicating that the missile is not launched; and means for producing a "ready to launch" signal in response to said "not launch" signal, the absence of said "ready to trigger" signal and the absence of said DET #1 signal.

* * * * *